US007303004B2

(12) United States Patent
Iwasa et al.

(10) Patent No.: US 7,303,004 B2
(45) Date of Patent: Dec. 4, 2007

(54) HEAT EXCHANGER

(75) Inventors: Akio Iwasa, Konan (JP); Muneo Sakurada, Konan (JP); Yoshihisa Eto, Konan (JP)

(73) Assignee: Valeo Thermal Systems Japan Corporation, Saitama (JP)

( * ) Notice: Subject to any disclaimer, the term of this patent is extended or adjusted under 35 U.S.C. 154(b) by 0 days.

(21) Appl. No.: 10/581,031

(22) PCT Filed: Aug. 25, 2004

(86) PCT No.: PCT/JP2004/012163

§ 371 (c)(1),
(2), (4) Date: May 30, 2006

(87) PCT Pub. No.: WO2005/052488

PCT Pub. Date: Sep. 6, 2005

(65) Prior Publication Data

US 2007/0114012 A1 May 24, 2007

(30) Foreign Application Priority Data

Nov. 28, 2003 (JP) ..... 2003-398858

(51) Int. Cl.
*F28D 1/02* (2006.01)
*F25B 43/00* (2006.01)

(52) U.S. Cl. ..... 165/153; 165/170

(58) Field of Classification Search ..... 165/153, 165/170, 176, 178; 62/515
See application file for complete search history.

(56) References Cited

U.S. PATENT DOCUMENTS 4,821,531 A * 4/1989 Yamauchi et al. ..... 62/515

(Continued)

FOREIGN PATENT DOCUMENTS

EP 1 001 238 5/2000

(Continued)

OTHER PUBLICATIONS

J.M. Jabardo et al., "Modeling and experimental evaluation of an automotive air conditioning system with a vaiable capacity compressor," International Journal of Refrigeration, Oxford, GB, vol. 25, No. 8, Dec. 2002 (Dec. 2002), pp. 1157-1172.

(Continued)

*Primary Examiner*—Tho Duong
(74) *Attorney, Agent, or Firm*—Wenderoth, Lind & Ponack, L.L.P.

(57) ABSTRACT

A heat exchanger adopts a four-pass structure, including two rows of tubes, a first upper tank portion communicating with the upper end of one of the tube rows, a second upper tank portion communicating with the upper end of the other tube row, a first lower tank portion communicating with the lower end of the one tube row, a second lower tank portion communicating with the lower end of the other tube row, a communicating passage that communicates between first ends of the first and second upper tank portions a partition partitioning each of the first and second upper tank portions, inflow and outflow ports communicating with the other ends of the first and second upper tank portions. The inflow port opening is smaller and has a higher center than the outflow port opening.

4 Claims, 3 Drawing Sheets

U.S. PATENT DOCUMENTS

| | | | | |
|---|---|---|---|---|
| 5,409,056 | A * | 4/1995 | Farry et al. | 165/153 |
| 5,735,343 | A * | 4/1998 | Kajikawa et al. | 165/153 |
| 5,826,648 | A * | 10/1998 | Shimoya et al. | 165/153 |
| 6,230,787 | B1 * | 5/2001 | Koga et al. | 165/41 |
| 6,272,881 | B1 * | 8/2001 | Kuroyanagi et al. | 62/525 |
| 6,321,562 | B1 * | 11/2001 | Narahara et al. | 62/503 |

FOREIGN PATENT DOCUMENTS

| | | |
|---|---|---|
| EP | 1 065 453 | 1/2001 |
| EP | 1 612 501 | 1/2006 |
| JP | 4-10289 | 1/1992 |
| JP | 7-12778 | 3/1995 |
| JP | 2001-074388 | 3/2001 |
| JP | 2002-340493 | 11/2002 |
| WO | 02/073144 | 9/2002 |

OTHER PUBLICATIONS

Supplementary European Search Report issued Sep. 3, 2007 in EP 04 77 2124 which is a foreign counterpart to the present application.

* cited by examiner

HEAT EXCHANGER

CROSS-REFERENCE TO RELATED APPLICATIONS

This application is the U.S. National Phase Application, under 35 USC 371 of International Application PCT/JP2004/012163, filed on Aug. 25, 2004, published as WO 2005/052488 A1 on Jun. 9, 2005, and claiming priority to JP 2003-398858, filed Nov. 28, 2003, the disclosures of all of which are incorporated herein by reference.

TECHNICAL FIELD

The present invention relates to a heat exchanger that may be an evaporator used as a component of a refrigerating cycle, and more specifically, it relates to a structure that may be adopted to achieve more uniform temperature distribution in the heat exchanging unit.

BACKGROUND ART

Heat exchangers in the related art include those adopting a four-pass structure that includes a plurality of tubes disposed over two rows to the front and the rear along the direction of airflow through which the coolant is caused to flow in the top-bottom direction, an upper tank portion communicating with the upper ends of the tubes and a lower tank portion communicating with the lower ends of the tubes (see Patent Reference Literature 1).

A tendency whereby the coolant flowing through an upper tank portion 100 flows in greater quantities to the tubes present on the upstream side along the coolant flowing direction due to gravity and the coolant flowing through a lower tank portion 101 flows in greater quantities to the tubes present on the downstream side along the coolant flowing direction due to the inertial force, as shown in FIG. 5(*a*) is often observed in a heat exchanger adopting the four-pass structure described above. This tendency leads to a lowered coolant flow rate over an area A at a first pass portion 110, an area B at a second past portion 111, an area C at a third pass portion 112 and an area D at a fourth pass portion 113 which, in turn, allows the temperature over these areas to rise readily. In particular, the temperature change over an area E (see FIG. 5(*b*)) formed with the part of the area A at the first pass portion 110 and the part of the area D at the fourth pass portion 113 overlapping each other along the front/rear direction of the airflow causes a disruption in the temperature distribution in the entire heat exchanging unit. The tendency becomes more pronounced when the coolant is circulated at a low flow rate.

The problem discussed above is addressed in the evaporator disclosed in Patent Reference Literature 1 by forming a plurality of restriction holes at the second pass portion and the fourth pass portion on the lower tank portion side so as to adjust the coolant flow rate (see Patent Reference Literature 1).

Patent Reference Literature 1: Japanese Unexamined Patent Publication No. 2001-74388

SUMMARY OF THE INVENTION

The heat exchanger disclosed in Patent Reference Literature 1 includes tanks with complicated structures, and thus, its production cost is high. In addition, the problem manifesting at the upper tank portion, as detailed above, i.e., the coolant flowing in greater quantities toward the front due to gravity, is not properly addressed in the heat exchanger.

Accordingly, an object of the present invention is to achieve more uniform temperature distribution with a higher level of efficiency while minimizing the increase in production cost.

The object described above is achieved in the present invention by providing a heat exchanger adopting a four-pass structure, comprising a plurality of tubes disposed so as to distribute a coolant along a top-bottom direction over two rows to the front and the rear along the direction of airflow, a first upper tank portion communicating with the upper end of the group of tubes disposed in one of the tube rows, a second upper tank portion communicating with the upper end of the group of tubes disposed in the other tube row, a first lower tank portion communicating with the lower end of the group of tubes disposed in the one tube row, a second lower tank portion communicating with the lower end of the group of tubes disposed in the other tube row, a communicating passage that communicates between one end of the first upper tank portion and one end of the second upper tank portion, a partition for partitioning the first upper tank portion and the second upper tank portion at substantial centers thereof, an inflow port communicating with the other end of the first upper tank portion, through which coolant from an outside source flows in and an outflow port communicating with the other end of the second upper tank portion, through which coolant flows out to the outside. The heat exchanger is characterized in that the area of the opening at the inflow port is set smaller than the area of the opening at the outflow port.

It is desirable that the center of the opening at the inflow port be positioned higher than the center of the opening at the outflow port.

It is also desirable that the area of the opening at the inflow port be within a range of 25 through 65 $mm^2$.

The heat exchanger according to the present invention is ideal in applications in a refrigerating cycle that includes a variable capacity compressor.

By reducing the opening area at the inflow port as described above, the speed with which the coolant flows in is raised and since the inflow port is formed at a higher position, the coolant having flowed into the first upper tank portion is allowed to flow further against gravity, and thus, the coolant is distributed substantially uniformly in the group of tubes constituting the first pass. As a result, a more uniform temperature distribution is achieved at the first pass portion. Since the part of the first pass portion and the part of the fourth pass portion set at positions to the front and to the rear relative to each other along the direction of the airflow, where the temperature rises to a high level, do not overlap, a uniform temperature distribution is assured in the entire heat exchanging unit. In addition, since the structure is achieved without requiring any additional parts, the increase in the production cost is minimized. Since the full benefit of the present invention becomes available when the coolant flow rate is set low, the present invention is ideal in applications in refrigerating cycles that include a variable capacity compressor.

DETAILED DESCRIPTION OF THE INVENTION

A preferred embodiment of the present invention is now explained with reference to the attached drawings.

Embodiment 1

Figure 1B:
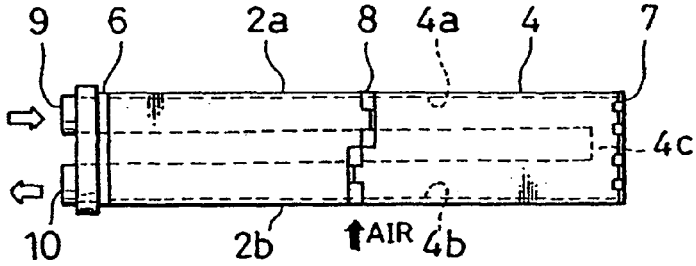
FIG. 1(*a*) presents a front view (center), FIG. 1(*b*) presents a top view (top), and FIG. 1(*c*) presents a side elevation (left side), all showing the structure adopted in an embodiment of the heat exchanger according to the present invention.
Figure 1C:
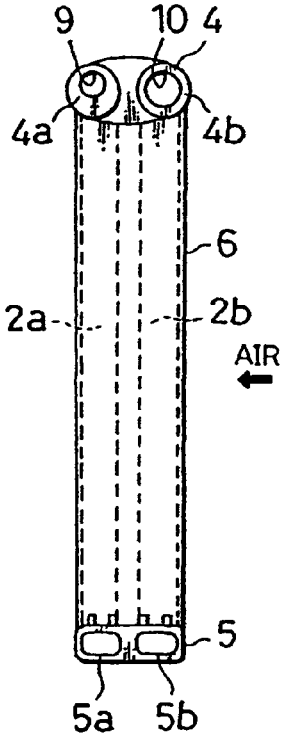
Figure 1A:
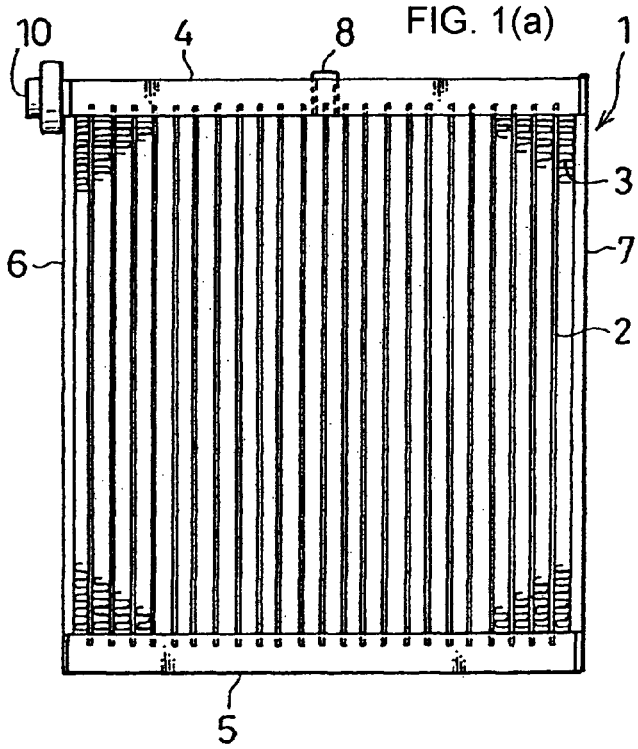

A heat exchanger 1 in FIGS. 1(*a*)-1(*c*), achieved in an embodiment of the present invention, is used as an evaporator constituting part of a refrigerating cycle, and comprises tubes 2, fins 3, an upper tank 4, a lower tank 5, end plates 6 and 7, a partitioning plate 8, an inflow port 9 and an outflow port 10.

The tubes 2 are hollow and formed in a flat shape by using a material such as aluminum. A plurality of tubes are disposed so as to allow coolant to be distributed along a top-bottom direction over two rows to the front and the rear along the direction of airflow. The tubes 2 include a first tube group 2*a* constituted with tubes disposed in the row on the downstream side along the direction of airflow and a second tube group 2*b* constituted with tubes disposed in the row on the upstream side along the direction of airflow. Corrugated fins 3 constituted of a material such as aluminum are inserted between the tubes 2, and the end plates 6 and 7 each constituted with a metal plate or the like are fixed onto the two ends of the tube/fin assembly along the direction in which the tubes 2 and the fins 3 are layered.

The upper tank 4 communicates with the upper ends of the tubes 2, and includes a first upper tank portion 4*a* formed on the downstream side along the direction of the airflow, a second upper tank portion 4*b* formed on the upstream side along the direction of airflow and a communicating passage 4*c* that communicates between the first upper tank portion 4*a* and the second upper tank portion 4*b* at their ends on the side opposite from the side where the inflow port 9 and the outflow port 10 are present. The first upper tank portion 4*a* communicates with the first tube group 2*a*, whereas the second upper tank portion 4*b* communicates with the second tube group 2*b*.

The lower tank 5 communicates with the lower ends of the tubes 2, and includes a first lower tank portion 5*a* formed on the downstream side along the direction of airflow and a second lower tank portion 5*b* formed on the upstream side along the direction of airflow. The first and second lower tank portions 5*a* and 5*b* do not communicate with each other. The first lower tank portion 5*a* communicates with the first tube group 2*a*, whereas the second lower tank portion 5*b* communicates with the second tube group 2*b*.

The partitioning plate 8 is disposed so as to partition the first upper tank portion 4*a* and the second upper tank portion 4*b* at substantial centers thereof.

Through the inflow port 9, the coolant having become depressurized in the refrigerating cycle is guided. The inflow port 9 is formed so as to communicate with the first upper tank portion 4*a*. The outflow port 10, through which the coolant having been circulated through the heat exchanger 1 is guided to an outside mechanism (such as a compressor), is formed so as to communicate with the second upper tank portion 4*b*.

Figure 2:
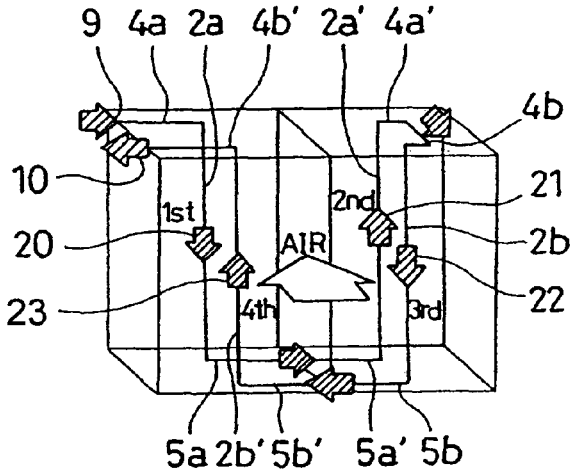
FIG. 2 shows the flow of coolant in the heat exchanger achieved in the embodiment.

The coolant is distributed through a four-pass flow inside the heat exchanger 1 adopting the structure described above, as shown in FIG. 2. Namely, the coolant having flowed in through the inflow port 9 travels through the first upper tank portion 4*a*→the first tube group 2*a*→a first pass portion 20 constituted with the first lower tank portion 5*a*, a first lower tank portion 5*a*'→a first tube group 2*a*'→a second pass portion 21 constituted with a first upper tank portion 4*a*', the second upper tank portion 4*b*→the second tube group 2*b*→a third pass portion 22 constituted with the second lower tank portion 5*b*, a second lower tank portion 5*b*'→a second tube group 2*b*'→a fourth pass portion 23 constituted with a second upper tank portion 4*b*', before it flows out through the outflow port 10.

Figure 3:
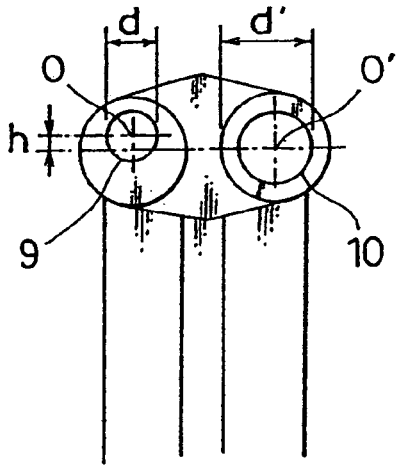
FIG. 3 shows the shapes of the inflow port and the outflow port in the heat exchanger achieved in the embodiment.

As shown in FIG. 3, the diameter d of the inflow port 9 in the heat exchanger 1 according to the present invention is set smaller than the diameter d' of the outflow port 10. In addition, the center O of the inflow port opening is set at a position higher than the center O' of the opening at the outflow port 10 by a distance h. It is also desirable that the diameter d at the inflow port 9 be set so that the area of the inflow port opening is within a range of 25~65 $mm^2$.

Figure 4A:
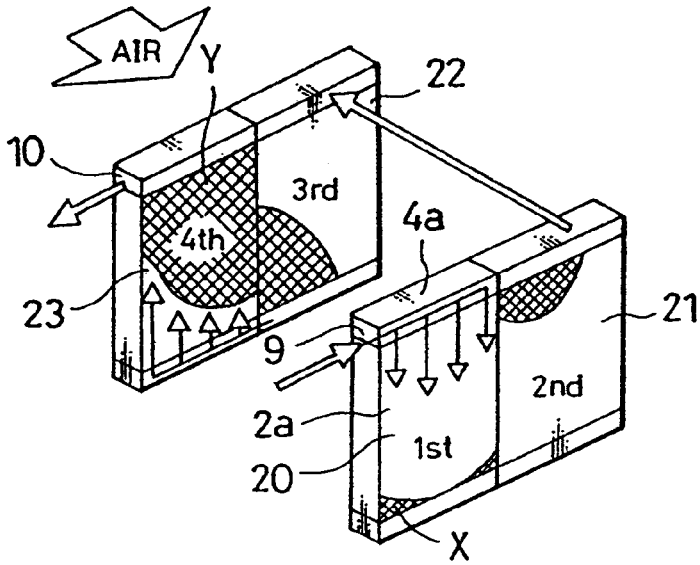
FIG. 4(*a*) shows the coolant flow characteristics achieved in the heat exchanger in the embodiment and FIG. 4(*b*) demonstrates the uniformity of the temperature distribution achieved in the heat exchanger.
Figure 4B:
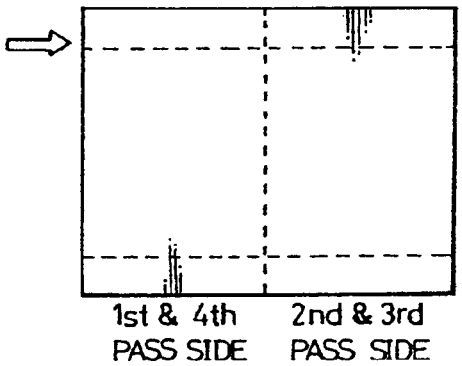
Figure 5A:
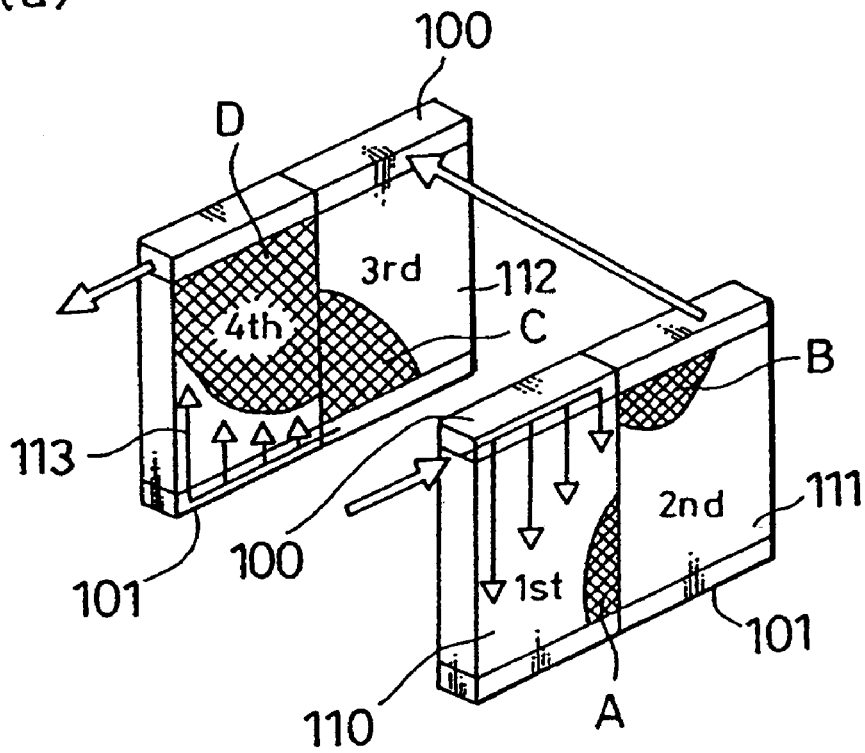
FIG. 5(*a*) shows the coolant flow characteristics observed in a heat exchanger in the related art and FIG. 5(*b*) shows the temperature distribution uniformity characteristics observed in the heat exchanger in the related art.
Figure 5B:
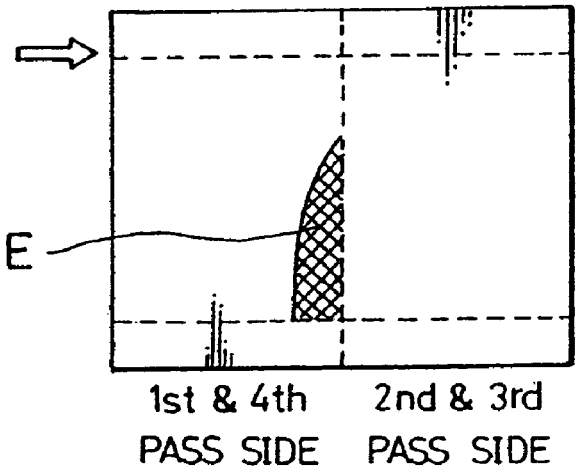

By reducing the opening area at the inflow port 9 as described above, the speed with which the coolant flows in is raised, and since the inflow port is formed at a position higher than normal, the coolant having flowed into the first upper tank portion 4*a* constituting the first pass 20 is allowed to flow further against gravity and is thus distributed substantially uniformly in the first tube group 2*a*, as shown in FIG. 4(*a*). As a result, an area X at the first pass portion 20 where the coolant flow rate is lower and the temperature rises to a higher level compared to the remaining area is greatly reduced compared to the related art. Since the reduced area X does not overlap an area Y to a significant extent at the fourth pass portion 23 where the temperature rises to a high level, assuming the front-rear positional relationship with the area X along the direction of airflow, a uniform temperature distribution is achieved over the entire heat exchanging unit, as shown in FIG. 4(*b*). In addition, the structure is achieved without requiring an additional part, allowing the heat exchanger to be manufactured with a minimum cost increase. Moreover, the full benefit of the present invention is obtained particularly when the coolant flow rate is low and, accordingly, the present invention is ideal in applications in a refrigerating cycle that includes a variable capacity compressor.

INDUSTRIAL APPLICABILITY

As described above, the present invention provides a heat exchanger achieving a uniform temperature distribution in the heat exchanging unit without increasing the manufacturing cost.

What is claimed is:

1. A heat exchanger adopting a four-pass structure, comprising:

a plurality of tubes disposed so as to distribute a coolant along a top-bottom direction over two rows to the front and rear along the direction of airflow;

a first upper tank portion communicating with the upper end of a group of tubes disposed in one of the tube rows;

a second upper tank portion communicating with the upper end of a group of tubes disposed in the other tube row;

a first lower tank portion communicating with the lower end of said group of tubes disposed in the one tube row;

a second lower tank portion communicating with the lower end of said group of tubes disposed in said other tube row;

a communicating passage that communicates between one end of said first upper tank portion and one end of said second upper tank portion;

a partitioning member partitioning said first upper tank portion and said second upper tank portion at substantial centers thereof;

an inflow port communicating with the other end of said first upper tank portion, through which coolant from an outside source flows in; and an outflow port communicating with the other end of said second upper tank portion, through which coolant flows out to the outside;

wherein said inflow port has an opening area smaller than an opening area of said outflow port;

wherein a center of the opening area of said inflow port is located at a position higher than a center of the opening area of said outflow port;

wherein the opening area of said inflow port is within a range of 25~65 $mm^2$;

wherein an end plate is fixed onto an end of said first upper tank portion and an end of said second upper tank portion; and wherein said inflow port and said outflow port are located at an outside of said end plate so as to open outside of said heat exchanger.

2. A heat exchanger according to claim 1, wherein said inflow port and said outflow port project outwardly from said end plate.

3. A refrigerating system configured to operate in accordance with a refrigerating cycle, said refrigerating system comprising an evaporator as a first component of the refrigerating cycle, and a variable capacity compressor as a second component of the refrigerating cycle, wherein said evaporator is constituted by a heat exchanger adopting a four-pass structure, said heat exchanger comprising:

a plurality of tubes disposed so as to distribute a coolant along a top-bottom direction over two rows to the front and rear along the direction of airflow;

a first upper tank portion communicating with the upper end of a group of tubes disposed in one of the tube rows;

a second upper tank portion communicating with the upper end of a group of tubes disposed in the other tube row;

a first lower tank portion communicating with the lower end of said group of tubes disposed in the one tube row;

a second lower tank portion communicating with the lower end of said group of tubes disposed in said other tube row;

a communicating passage that communicates between one end of said first upper tank portion and one end of said second upper tank portion;

a partitioning member partitioning said first upper tank portion and said second upper tank portion at substantial centers thereof;

an inflow port communicating with the other end of said first upper tank portion, through which coolant from an outside source flows in; and an outflow port communicating with the other end of said second upper tank portion, through which coolant flows out to the outside;

wherein said inflow port has an opening area smaller than an opening area of said outflow port;

wherein a center of the opening area of said inflow port is located at a position higher than a center of the opening area of said outflow port;

wherein the opening area of said inflow port is within a range of 25~65 $mm^2$;

wherein an end plate is fixed onto an end of said first upper tank portion and an end of said second upper tank portion; and wherein said inflow port and said outflow port are located at an outside of said end plate so as to open outside of said heat exchanger.

4. A refrigerating system according to claim 3, wherein said inflow port and said outflow port project outwardly from said end plate.

* * * * *